United States Patent [19]

Fisher et al.

[11] Patent Number: 4,616,777

[45] **Date of Patent: * Oct. 14, 1986**

[54] AIR-CONDITIONING SYSTEM

[75] Inventors: Gary H. Fisher; H. Pat Padgett, both of Rockingham, N.C.

[73] Assignee: Industrial Sheet Metal & Mechanical Corporation, Rockingham, N.C.

[ * ] Notice: The portion of the term of this patent subsequent to Nov. 12, 2002 has been disclaimed.

[21] Appl. No.: 761,419

[22] Filed: Aug. 1, 1985

Related U.S. Application Data

[63] Continuation of Ser. No. 415,577, Sep. 7, 1982, Pat. No. 4,552,303.

[51] Int. Cl.[4] ..... B01F 3/02

[52] U.S. Cl. ..... 236/44 C; 62/171; 165/16

[58] Field of Search ..... 236/49, 44 B, 44 C; 62/91, 179, 171; 165/19, 16

[56] References Cited

U.S. PATENT DOCUMENTS

| | | | |
|---|---|---|---|
| 2,120,299 | 6/1938 | Stramaglia | 62/179 |
| 4,089,666 | 5/1978 | Knight | 62/91 |
| 4,540,118 | 9/1985 | Lortie et al. | 236/44 C |
| 4,552,303 | 11/1985 | Fisher et al. | 236/44 C |

*Primary Examiner*—William E. Wayner

*Attorney, Agent, or Firm*—Bell, Seltzer, Park & Gibson

[57] ABSTRACT

An improved, energy-efficient method and apparatus for cooling and conditioning the air being supplied to an air-conditioned area in which the volumetric flow rate of the air being directed through a spray chamber is varied in response to changes in the heat load in the air-conditioned area while the volume of water sprayed by the spray chamber is also varied so as to maintain a predetermined ratio between the volumes of spray water and air flow.

7 Claims, 5 Drawing Figures

AIR-CONDITIONING SYSTEM

This application is a continuation, of application Ser. No. 415,577, filed Sept. 7, 1982 now U.S. Pat. No. 4,552,303.

BACKGROUND OF THE INVENTION

This invention relates to an air-conditioning system for controlling the temperature and humidity conditions in an air-conditioned area.

The invention more particularly relates to an air-conditioning system of the type in which air is directed through a spray chamber and into direct contact with a spray of water for cooling and conditioning the air and the thus cooled and conditioned air is then supplied to the air-conditioned area. This type of air-conditioning system, sometimes referred to as an "air washer" system, is used most often in industrial applications where both the temperature and the humidity of the air in the air-conditioned area must be controlled within fairly close limits.

It should be understood that in such industrial applications, because of the heat load from the industrial equipment, lighting, and inhabitants as well from the roof and walls of the building, cooling is generally required year-round. The temperature and humidity conditions within the building are controlled by withdrawing air from the building and circulating it through an air-conditioning unit where cooling and/or reheating of the air is carried out as necessary to provide the desired temperature and humidity conditions. A portion of the air may be replaced with fresh outside air prior to the cooled and conditioned air being returned from the air-conditioning unit to the building.

In perhaps the most well-known type of air washer air-conditioning system, the spray of water cools the air to or near the saturation point in order to attain the level of moisture needed to provide the desired relative humidity at the final temperature, and the air is then reheated to bring it to the final temperature with the desired relative humidity level. This approach is particularly well suited for accurately controlling both the temperature and the relative humidity of the air, but is inefficient since energy is required both for initially cooling the air and then for reheating it to the desired final temperature and relative humidity.

In an effort to conserve energy, other known systems have been produced wherein a portion of the air is directed to bypass the spray chamber in order to minimize or avoid the need for subsequent reheating of the air. However, the energy requirements for this type of system are still quite substantial.

In still another type of air washer air-conditioning system, described in U.S. Pat. No. 4,089,666, issued May 16, 1978, efforts were made to further reduce energy requirements by varying the volume of the spray water used for cooling the air in response to variations in the temperature in the air-conditioned area. While this approach provided improvements in energy efficiency over the prior systems noted above, the need still exists for further reducing and conserving energy usage.

SUMMARY OF THE INVENTION

The present invention provides an improved and more energy efficient method and apparatus for cooling and conditioning the air in an air-conditioning system of the air washer type.

In accordance with the present invention these improvements and advantages are realized by varying the volumetric flow rate of the air being directed through the spray chamber and supplied to the air-conditioned area in response to changes in the heat load in the air-conditioned area while also varying the volume of water sprayed by the spray chamber so as to maintain a predetermined ratio between the volumes of spray water and air flow.

More particularly, in accordance with the present invention the air flow rate is varied over a predetermined range extending from a predetermined maximum flow rate to a predetermined minimum flow rate which is a fraction of the maximum flow rate. For example, the flow of air may be varied from 100% to 25% of the maximum capacity of the system. The volume of water sprayed by the spray chamber is varied so as to maintain the ratio between the volumes of spray water and air flow substantially constant over this predetermined range of air flow rates.

The heat load in the air-conditioned area is determined by sensing the dry bulb temperature of the air. When the heat load in the air-conditioned area is reduced, and hence the dry bulb temperature in the air-conditioned area falls, the volume of cooled and conditioned air being delivered to the air-conditioned area is reduced. As the air volume is reduced, the volume of spray water is correspondingly reduced so as to maintain the ratio of spray water volume to air flow substantially constant. It will thus be seen that a reduction in the heat load in the air-conditioned area directly results in a reduction in the energy required by the system. Both the energy required for circulating the air and the energy required for chilling the spray water are reduced in response to a reduction in heat load. In contrast, with the prior art reheat system described earlier energy consumption may actually increase with a reduction in heat load, since in order to maintain the desired temperature and humidity conditions it will be necessary to offset the reduced heat load in the air-conditioned area by additional reheating in the air-conditioning unit. It has been shown that an air-conditioning system in accordance with the present invention may be operated at a yearly energy cost approximately 38% of that required by a conventional prior art system using spray cooling with reheating.

In order to maintain effective distribution of the air throughout the building, it is desirable to maintain some predetermined air flow rate at all times. Thus, the air flow rate is typically varied over some predetermined range extending from the maximum capacity of the air distribution system to some predetermined minimum flow rate which is a fraction of the maximum flow rate. When the heat load in the air-conditioned area drops to such a level that the air flow rate reaches the predetermined minimum level, further reductions in the heat load in the air-conditioned area result in maintaining the air flow rate at the predetermined minimum flow rate while continuing to reduce the volume of spray water, resulting in a reduction in the saturation efficiency of the spray washer.

A further aspect of the present invention involves also varying the temperature of the spray water in response to changes in the dew point of the air in the air-conditioned area so as to maintain the dew point at a predetermined level.

BRIEF DESCRIPTION OF THE DRAWINGS

Some of the features and advantages of the invention having been described, others will become apparent as the description proceeds, when taken in connection with the accompanying drawings, in which.

DESCRIPTION OF ILLUSTRATED EMBODIMENT

Figure 1:
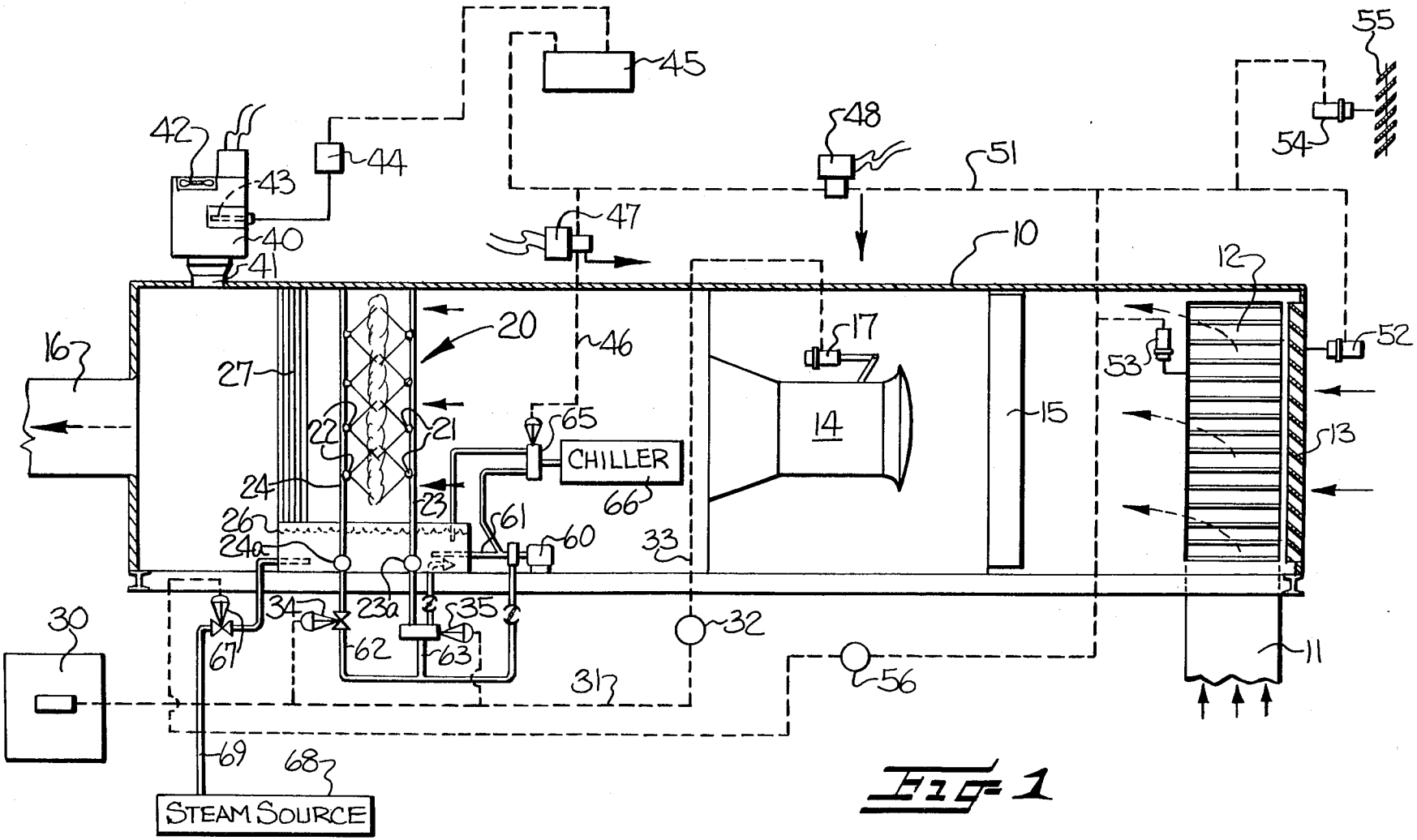
FIG. 1 is a schematic side elevational view of an arrangement of apparatus embodying the features of the present invention.

Referring now more particularly to the drawings, in FIG. 1 there is illustrated an air handling unit which embodies the features of the present invention. As illustrated, the apparatus includes an elongate substantially airtight housing 10 through which the air which is to be cooled and conditioned flows. A return air duct 11 connected to one end of the housing 10 supplies air from the air-conditioned area to the housing, with the flow of air entering the housing from the return air duct 11 being controlled by return air dampers 12. Outside air dampers 13 also provide for the introduction of outside air into the housing for mixing with the recirculated return air as conditions dictate.

A supply air fan 14 is located centrally within the housing to draw air into the housing through the return air dampers 12 and/or outside air dampers 13. The air passes through a filter 15, and after being cooled and conditioned as hereinafter more fully described, is discharged from the housing and returned to the air-conditioned area via a supply air duct 16. The supply air fan 14 is of a construction which permits the volumetric rate of air flow to be varied as desired. The varying of the air flow may be accomplished by various known means, including the use of inlet vane control devices, variable speed fan motors, and multi-stage axial fans. The preferred type of fan, however, from the standpoint of economy and efficiency is one with variable pitch fan blades. A variable pitch fan is highly desirable since it is capable of providing reduced air flow with a near ideal reduction in input power requirement. In the embodiment illustrated, a blade pitch actuator 17 is operatively connected to the fan 14 for controlling the pitch of the fan blades.

Figure 2:
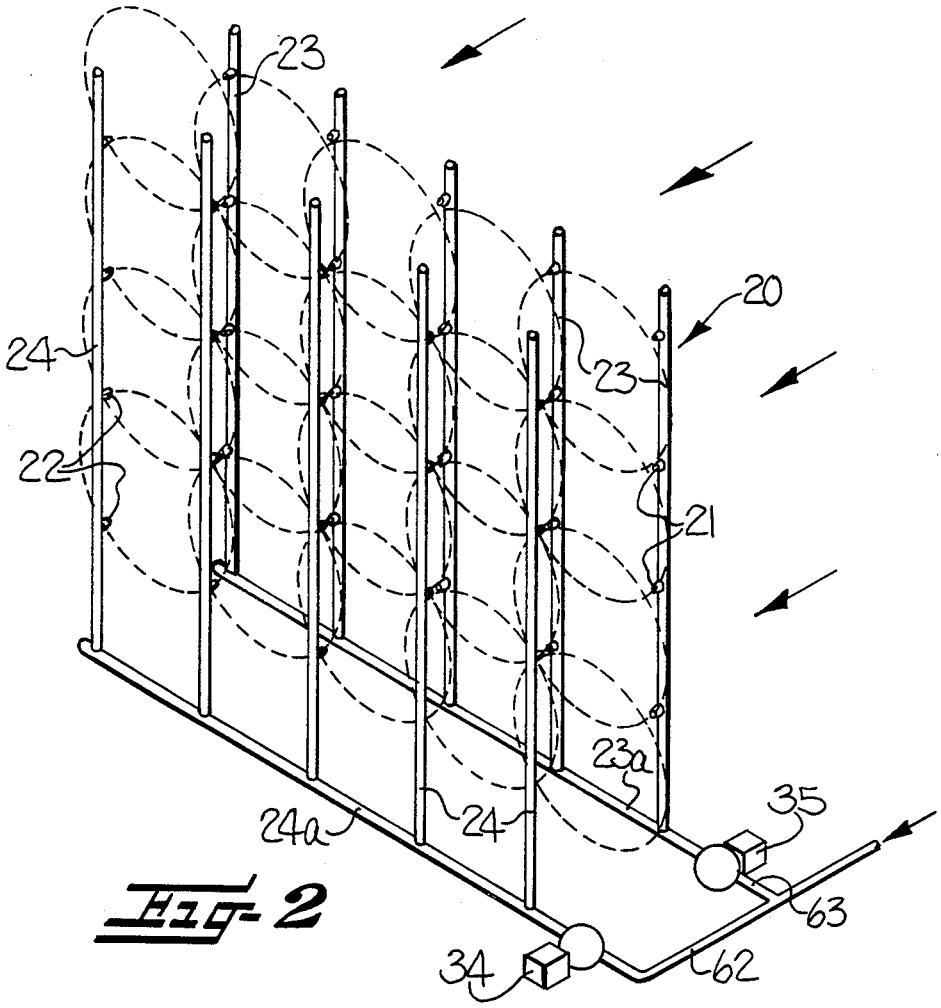
FIG. 2 is a schematic perspective illustration of the spray chamber of the air-conditioning apparatus.

On the discharge side of the fan 14 is provided a spray chamber, generally indicated at 20, which discharges a spray of water across the path of travel of the air for cooling and conditioning the same. As best seen in FIG. 2, the spray chamber 20 more particularly includes opposing pairs of spray nozzles 21, 22 mounted at spaced-apart locations throughout the path of travel of the air within the housing 10. The spray nozzles 21 are oriented facing the downstream direction and are connected to respective risers 23 extending vertically within the housing at laterally spaced-apart locations from one another. Each riser 23 is connected to a manifold 23*a*. Spray nozzles 22 face upstream and are connected to respective risers 24, which, in turn, are connected to a manifold 24*a*. The opposing pairs of nozzles 21, 22 are so arranged that their conical sprays impinge upon one another to form a fine mist for providing intimate contact with the air. The excess spray is received and collected in a reservoir 26 (FIG. 1) located at the base of the spray chamber 20. On the downstream side of the spray chamber 20, a mist eliminator 27 extends across the path of flow of the air and serves for removing excess entrained water mist from the air stream. Upon leaving the mist eliminator 27, the cooled and conditioned air flows into supply air duct 16 and is conducted to the air-conditioned area.

Referring now in more detail to the control system, a dry bulb thermostat 30 is located in the air-conditioned area for sensing the dry bulb temperature of the air in the air-conditioned area. In the particular embodiment illustrated, the thermostat 30 and the associated control lines and control mechanisms are pneumatically operated, but those skilled in the art will readily recognize that the features of the present invention illustrated and described herein could also be carried out in other ways, such as electrically. A pneumatic control line 31 leads from the thermostat 30 to a reversing relay 32 and thence along a control line 33 to the blade pitch actuator 17. When thermostat 30 calls for maximum cooling in the air-conditioned area, the blade pitch actuator 17 is positioned to provide maximum air flow from the fan 14. When the heat load in the air-conditioned area decreases, as may occur for example when heat generating machinery in the air-conditioned area is turned off, the temperature in the air-conditioned area falls. The reduction in dry bulb temperature in the air-conditioned area is sensed by the thermostat 30 and causes the blade pitch actuator 17 to reduce the volume of cooled and conditioned air being supplied to the air-conditioned area. At this point, a further reduction in temperature in the air-conditioned area would produce a further reduction in the volume of air being supplied to the air-conditioned area, while an increase in temperature would cause the actuator 17 to increase the volume of air being supplied by the fan 14 to the air-conditioned area.

In order to insure proper operation of the duct distribution system, and to maintain at least some circulation of air throughout the air-conditioned area, a lower limit is imposed on the blade pitch actuator such that even under reduced flow conditions, there will always be some air flow produced by the fan. This minimum air flow level may be selected as desired depending upon the particular installation. Thus, for example, the minimum air flow level may be selected at 25% or 50% or 75% of the maximum flow condition.

A pump 60 withdraws the spray water from the reservoir 26 via a pipe 61 and pumps the water along pipes 62, 63 through throttling valves 34, 35 and to the respective manifolds 23*a*, 24*a*. The temperature of the spray water may be controlled as needed depending upon the conditions to be maintained in the air-conditioned area. To this end, a chilled water control valve 65 allows for chilled water from a supply source 66 to be added to the water in the reservoir 26 as is necessary to maintain the water at the desired temperature. Heating of the spray water may be accomplished by opening a steam injection valve 67 to allow steam from a source 68 to be injected into the reservoir through a pipe 69.

As the volumetric flow rate of air supplied by fan 14 is decreased, the volume of water sprayed in the spray chamber is correspondingly decreased so that the flow rate ratio of spray water to air is maintained at a predetermined level. Preferably, this ratio is maintained substantially constant throughout the range of operation of the fan 14. For example, it is particularly desirable to maintain the water-to-air ratio substantially constant at a ratio of about 8 gallons per minute of water per 1,000 cubic feet per minute of air.

When the heat load in the air-conditioned area is reduced to such a point that the air flow from fan 14 reaches its lower limit and the thermostat 30 still calls for reduced cooling, the spray throttling valves 34 and 35 will continue to reduce the spray volume and thereby reduce the efficiency of the spray washer 20 until the thermostat 30 is satisfied. In this regard it will be seen that the spray throttling valves 34 and 35 are connected to the control line 31 from thermostat 30.

Figure 3:
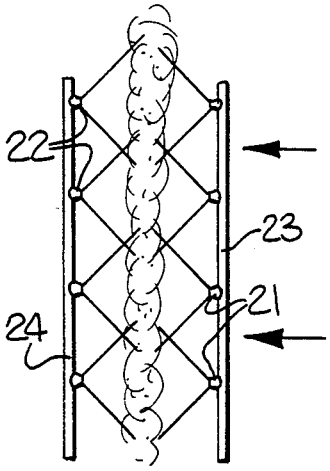
FIGS. 3–5 are schematic side elevational illustrations of the spray chamber apparatus under three different conditions of operation.

FIGS. 2–5 illustrate the preferred manner of controlling the spray volume in the spray washer 20 pursuant to the present invention. FIGS. 2 and 3 illustrate the operation of the spray nozzles under a substantially full flow condition. It will be seen that each of the opposing pairs of nozzles forms a conical spray which impinges with the oppositely positioned nozzle. The respective nozzles on each manifold are so positioned that the conical spray patterns overlap one another and thus substantially the entire flow area within the spray chamber is covered by the spray.

Figure 4:
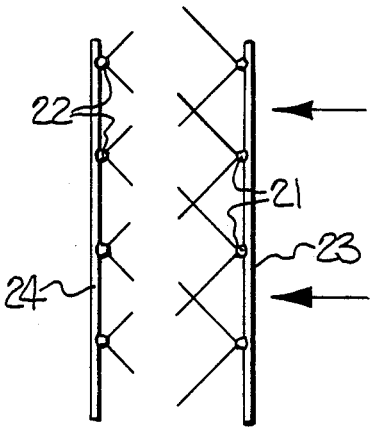
Figure 5:
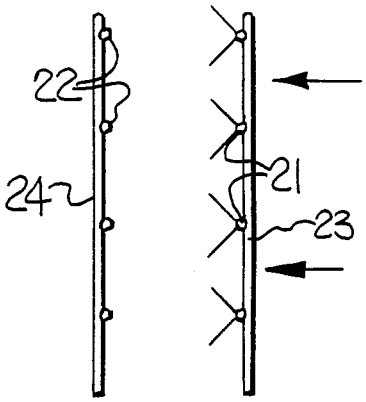

When conditions call for a reduction in the volume of spray water, the spray throttling valves 34 and 35 are so arranged that the throttling valve 35 serving the downstream manifold operates first to reduce the flow of water. Thus as seen in FIG. 4, in a reduced flow condition, the spray nozzles 21 on risers 23 remain operating in a substantially full flow condition with the spray patterns overlapping one another to substantially cover the entire flow area of the spray chamber, while the spray nozzles 22 on risers 24 spray a reduced volume of water.

If conditions call for a still further reduction in the spray water volume, throttling valve 34 continues to close until there is substantially no flow from nozzles 22. Throttling valve 35 then begins to close to reduce the flow of water from the upstream-located spray nozzles 21. It will be seen that as the flow volume from nozzles 21 is reduced, the spray patterns cease to overlap and thus allow a portion of the air to pass through the spray chamber unaffected by the spray water. In this manner, the saturation efficiency of the spray washer 22 is reduced so that the air being discharged from the spray washer into the supply air duct 16 has the desired temperature and humidity conditions.

As earlier noted, the relative humidity of the air may be controlled by varyiing the temperature of the spray water in response to variations in the dew point of the air discharged from the air handling unit 10. As illustrated in FIG. 1, a dew point sensor is located at the discharge end of the housing 10 for sensing the dew point of the air. The dew point sensor illustrated comprises a commercially available sensor having an inlet opening 41 connected to the housing 10, a fan 42 for drawing air from the housing through the opening 41 and into the sensor unit 40 and across a sensing element 43 located in the path flow of the air. The particular dew point sensor 40 illustrated is a Foxboro Dewcell Aspirator, although those skilled in the art will recognize the dew point sensing devices available from other manufacturers may be suitably employed. The dew point sensing element 43 is connected to a dew point transmitter 44 which, in turn, is connected to a dew point receiver-controller 45. Control line 46 connects the dew point receiver-controller 45 to the chilled water control valve 65 such that variations in the dew point of the air as sensed by the dew point sensor result in variations in the amount of chilled water admitted to the spray chamber by the chilled water control valve 65 and consequently result in varying the temperature of the spray water in the spray chamber 20 so as to maintain the dew point of the air at a predetermined desired level. It will be noted that the control line 46 leading to the chilled water control valve 65 is controlled by a relay 47. This relay 47 and another relay 48 are controlled by a summer-winter switch (not shown). When the summer-winter switch is in the summer position, relay 47 connects the dew point controller 45 to the chilled water control valve 65. During winter months when relatively cool outside air is available for cooling, relay 48 is typically actuated and the dew point receiver-controller 45 is connected through control line 51 to actuator motors 52, 53 and 54 for controlling respectively the outside air dampers 13, the return air dampers 12 and exhaust air dampers 55. Control line 51 also is connected to a reversing relay 56 which in turn is connected to the steam injection valve 67. The above arrangement permits outside air to be used whenever possible for providing the desired humidity and temperature control so as to thereby further minimize the amount of energy required for cooling and humidification of the air.

It will thus be seen that very significant savings in energy consumption are realized by the air-conditioning system of the present invention since any reduction in heat load in the air-conditioned area brings about a corresponding reduction in energy consumption by the air-conditioning system, including not only a reduction in the energy required for powering the fan of the air-handling unit but also a reduction in the cooling requirements for the spray water itself. This is in sharp contrast to the conventional air-conditioning systems heretofore used, especially those requiring reheating of the air, where energy is consumed simultaneously for cooling and reheating the air in order to bring it to the proper temperature and humidity conditions.

In the drawings and specification, there has been set forth a preferred embodiment of the invention, and although specific terms are employed, they are used in a generic and descriptive sense only and not for purposes of limitation.

We claim:

1. An energy efficient air conditioning system for conditioning the air being delivered to an air conditioned area comprising, in combination a housing having an inlet end for receiving air to be conditioned and a discharge end connected to a supply duct for delivering conditioned air to the conditioned area, return air damper means associated with said inlet end of the housing for controlling the admission of return air from the air conditioned area to the housing, outside air damper means associated with said inlet end of the housing for controlling the admission of outside air into the housing, variable capacity fan means cooperating with said housing for directing air at a desired flow rate through the housing from said inlet end toward said discharge end thereof, spary means located in the path of air flow through the housing for contacting the air which passes through the housing with a spray of water to cool and condition the air, mist eliminator means extending across the path of air flow between said spray means and the discharge end of said housing for removing excess water mist from the airstream, dew point sensing means for sensing the dew point of the conditioned air which is delivered to the conditioned area, control means associated with said dew point sensing means for controlling the operation of said return air damper means and said outside air damper means, temperature sensing means for sensing the dry bulb temperature of the air in the conditioned area, and control means associated with said temperature sensing means for modulating the capacity of said variable capacity fan means and also regulating the quantity of water which is directed into contact with the air by said spray means.

2. The air conditioning system as set forth in claim 1 wherein said housing includes a reservoir for supplying water to said spray means and for receiving and collecting excess spray from the spray means, and including means for heating and cooling the water in said reservoir.

3. The air conditioning system according to claim 2 wherein said control means associated with said dew point sensing means is also operable for controlling operation of said heating and cooling means.

4. The air conditioning system according to claim 1 wherein said spray means includes at least two spray nozzle assemblies, and means for independently controlling the flow of water to each of spray nozzle assemblies.

5. An energy efficient air conditioning system for conditioning the air being delivered to an air conditioned area comprising, in combination a housing having an inlet end for receiving air to be conditioned and a discharge end connected to a supply duct for delivering conditioned air to the conditioned area, return air damper means associated with said inlet end of the housing for controlling the admission of return air from the air conditioned area to the housing, outside air damper means associated with said inlet end of the housing for controlling the admission of outside air into the housing, variable capacity fan means cooperating with said housing for directing air at a desired flow rate through the housing from said inlet end toward said discharge end thereof, spray means located in the path of air flow through the housing for contacting the air which passes through the housing with a spray of water to cool and condition the air, reservoir means provided in said housing for supplying water to said spray means and for receiving and collecting excess spray water from said spray means, means associated with said reservoir for heating and cooling the water maintained in the reservoir, dew point sensing means for sensing the dew point of the conditioned air which is delivered to the conditioned area, control means associated with said dew point sensing means for controlling operation of said return air damper means, said outside air damper means, and said means for heating and cooling the water in said reservoir, temperature sensing means for sensing the dry bulb temperature of the air in the conditioned area, and control means associated with said temperature sensing means for modulating the capacity of said variable capacity fan means and also regulating the quantity of water which is directed into the air by said spray means.

6. An energy efficient air conditioning system for conditioning the air being delivered to an air conditioned area comprising, in combination a housing having an inlet end for receiving air to be conditioned and a discharge end connected to a supply duct for delivering conditioned air to the conditioned area, return air damper means associated with said inlet end of the housing for controlling the admission of return air from the air conditioned area to the housing, outside air damper means associated with said inlet end of the housing for controlling the admission of outside air into the housing, variable capacity fan means cooperating with said housing for directing air at a desired flow rate through the housing from said inlet end toward said discharge end thereof, spray means located in the path of air flow through the housing for contacting the air which passes through the housing with a spray of water to cool and condition the air, dew point sensing means for sensing the dew point of the conditioned air which is delivered to the conditioned area, control means associated with said dew point sensing means for controlling the operation of said return air damper means and said outside air damper means, temperature sensing means for sensing the dry bulb temperature of the air in the conditioned area, and control means associated with said temperature sensing means for modulating the capacity of said variable capacity fan means over a predetermined range extending from a predetermined maximum air flow rate to a predetermined minimum air flow rate and also regulating the quantity of water which is directed into contact with the air by said spray means correspondingly with variations made in the air flow rate so as to maintain the ratio between the volumes of spray water and air flow substantially constant over said predetermined range of air flow rates.

7. An energy efficient method for conditioning the air being supplied to an air conditioned area, said method comprising directing a flow of air along a predetermined path through a air conditioning system and to the conditioned area, contacting the air in its course of travel through the air conditioning system with a spray of water to condition the air, sensing the dew point of the conditioned air delivered to the conditioned area and in response thereto regulating the flow of return air withdrawn from the conditioned area and the flow of outside air admitted to the air conditioning system to thereby maintain the dew point of the air in the conditioned area at a desired level, sensing the demand for conditioned air being delivered to the conditioned area by sensing the dry bulb temperature of the air in the conditioned area, and in response to a change in the demand for conditioned air being delivered to the conditioned area modulating the flow of conditioned air being directed through the air conditioning system to the conditioned area while also regulating the quantity of water being sprayed into contact with the air passing through the air conditioning system to thereby maintain the temperature of the air in the conditioned area at a desired level.

* * * * *